US008479372B2

(12) United States Patent
Lark et al.

(10) Patent No.: US 8,479,372 B2
(45) Date of Patent: Jul. 9, 2013

(54) RING ENGRAVING FIXTURE

(75) Inventors: David B. Lark, Kingsley, MI (US); Christian DeCamillis, Traverse City, MI (US); David W. Skrzypczak, Interlochen, MI (US)

(73) Assignee: SDL Precision, LLC, Traverse City, MI (US)

( * ) Notice: Subject to any disclaimer, the term of this patent is extended or adjusted under 35 U.S.C. 154(b) by 301 days.

(21) Appl. No.: 12/884,867

(22) Filed: Sep. 17, 2010

(65) Prior Publication Data

US 2011/0067546 A1 Mar. 24, 2011

Related U.S. Application Data

(60) Provisional application No. 61/243,639, filed on Sep. 18, 2009.

(51) Int. Cl.
*B26D 3/08* (2006.01)
*B25B 5/00* (2006.01)

(52) U.S. Cl.
USPC ..... 29/560; 451/51; 451/379; 451/397; 451/398; 451/402; 29/896.412; 83/879

(58) Field of Classification Search
USPC ..... 29/896.412, 560; 451/51, 379, 397, 451/398, 402; 83/879
See application file for complete search history.

(56) References Cited

U.S. PATENT DOCUMENTS

| | | | | |
|---|---|---|---|---|
| 2,374,322 | A * | 4/1945 | Bickel | 82/143 |
| 2,381,422 | A * | 8/1945 | Bickel | 82/117 |
| 2,389,746 | A * | 11/1945 | Sparks et al. | 82/117 |
| 2,410,026 | A * | 10/1946 | Groene et al. | 82/132 |
| 3,451,685 | A * | 6/1969 | Butler | 279/5 |
| 4,331,452 | A * | 5/1982 | Causey et al. | 451/67 |
| 6,827,631 | B2 * | 12/2004 | Tomotaki et al. | 451/11 |
| 2003/0177650 | A1 * | 9/2003 | Ishikawa et al. | 33/18.1 |
| 2005/0173377 | A1 * | 8/2005 | Pietsch et al. | 216/88 |
| 2007/0111640 | A1 * | 5/2007 | Bem et al. | 451/6 |
| 2008/0213057 | A1 * | 9/2008 | Betschon et al. | 409/232 |
| 2009/0095126 | A1 * | 4/2009 | Hyatt et al. | 74/822 |

OTHER PUBLICATIONS

Shor International Corp., Quadrants and Dividers, website catalog page, 2006, 6 pages, www.ishor.com, U.S.

Moodie E. Braun, Jr., Make Your Own Gemstone Faceting Machine, magazine article, date unknown (but believed prior to 2006), 7 pages, Popular Mechanics, U.S.

(Continued)

*Primary Examiner* — Peter DungBa Vo
*Assistant Examiner* — Anthony Green
(74) *Attorney, Agent, or Firm* — Traverse Legal, PLC

(57) ABSTRACT

A ring fixture system for rotating a ring to perform engraving work. The system comprises a vise-securable fixture base with opposing mandrels connected through spaced arms of the fixture base at a ring-engraving location between the arms to form a mandrel assembly. The mandrels are provided with sets of detents with different degrees of rotational spacing, and the detents on one mandrel of the mandrel assembly can be engaged independently of the other set of detents on the other mandrel. The fixture base further includes a tool-supporting bridge connected between the fixture arms above the ring-engraving location to hold an engraving tool orthogonally to the ring axis, and may further include a sliding tool support on the bridge. Also, a method is disclosed for engraving a ring using the ring fixture system with the detents and tool-supporting bridge.

16 Claims, 10 Drawing Sheets

OTHER PUBLICATIONS

Mill Rite Machine, untitled photo of ring faceting machine, date unknown (but believed prior to 2006), 1 page, publisher unknown, U.S.

Pepe Tools, Wax Modeling Mandrels, catalog page, date unknown (but believed prior to 2006), 1 page, Pepe Tools, U.S.

Bergeron, untitled photo of ring fixture/faceting machine, date unknown (but believed prior to 2006), 1 page, Bergeron, U.S.

Christian Decamillis, Declaration with photos of Glendo 2006 Ring Fixtures, 2010 (2006), 9 pages, Christian DeCamillis, U.S.

* cited by examiner

FIG. 11
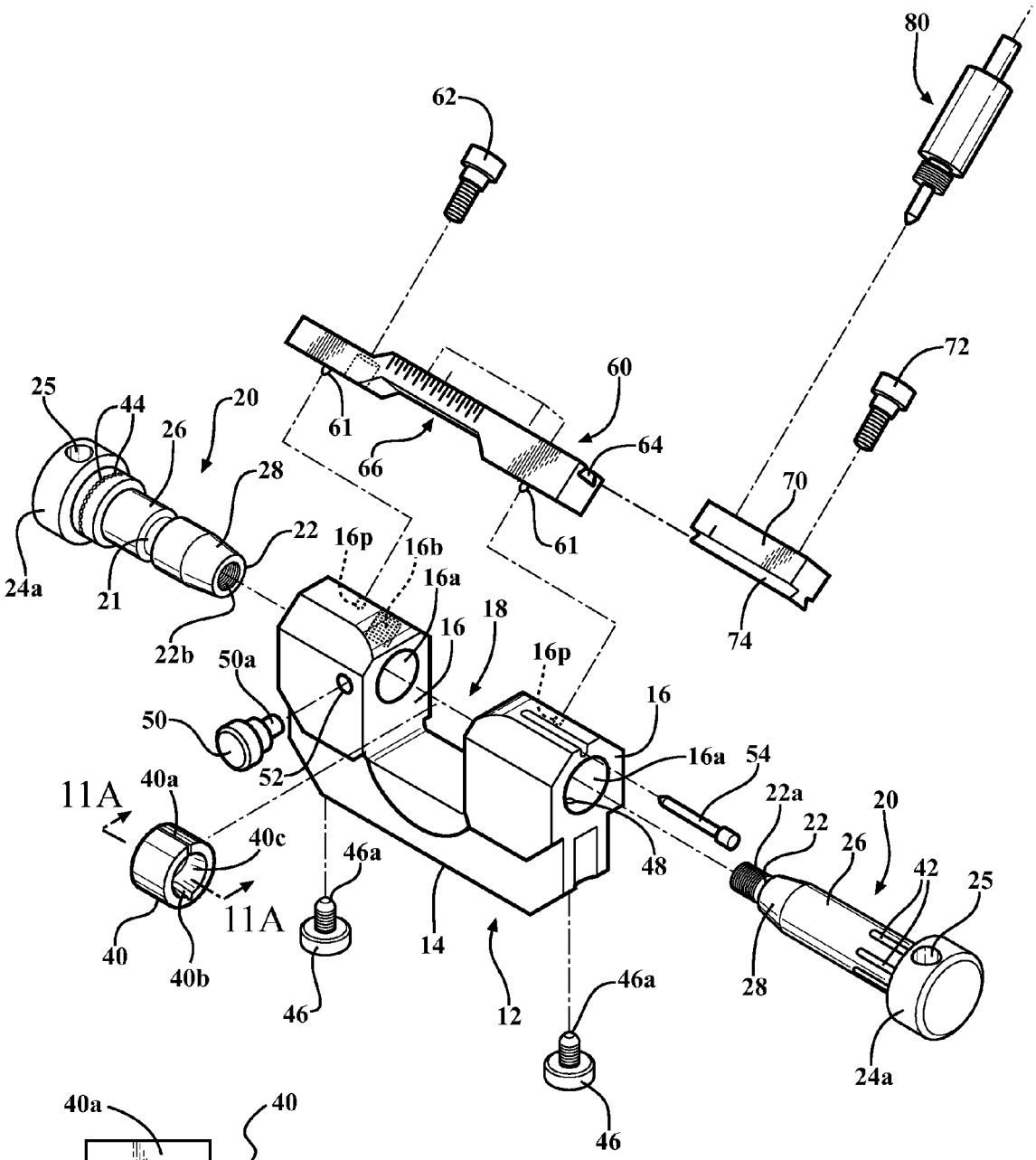
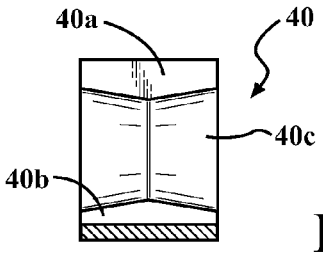
FIG. 11A

RING ENGRAVING FIXTURE

RELATED APPLICATIONS/PRIORITY BENEFIT CLAIM

This application claims the benefit of the priority of U.S. provisional patent application No. 61/243,639 filed Sep. 18, 2009 by the same inventors, which provisional patent application is incorporated herein by reference in its entirety.

FIELD

The subject matter of the present application is in the field of ring engraving fixtures used by jewelers for tasks such as ring engraving and stone setting, and in particular such fixtures that use a mandrel and collet to rotationally position a ring.

BACKGROUND

Ring fixtures using a rotating horizontal mandrel and removable ring-supporting collet are known. Ring fixtures are used to support and rotate a ring for doing layouts (marking the surface of a ring for further work), engraving, drilling, channel cutting, stone-setting, and other tasks known to jewelers (hereafter "engraving"). Such ring fixtures generally use a cantilevered mandrel with a removable ring-supporting collet secured to the end of the mandrel, the mandrel typically being supported in a jewelers' vise or in a handheld base.

Ring engraving requires precision and steadiness, and is challenging and time-consuming. Existing ring fixtures often leave much to be desired in terms of vibration, convenience, repeatability, access to the ring, and control over the ring's rotation. Existing ring fixtures also generally require frequent stopping and starting to adjust the fixture as work progresses around the ring.

BRIEF SUMMARY

We have invented a ring fixture comprising first and second opposing mandrels rotatably secured to one another in a fixture base. The mandrels comprise connectable inner ends and knob outer ends, and are rotatably mounted in spaced fixture arms integrated with the fixture base. The mandrels are aligned in opposing fashion such that their inner ends are coaxially aligned and can be connected in a ring-engraving location defined between the fixture arms, to form an integrated rotating mandrel assembly for supporting a ring between the fixture arms. The outer ends of the mandrels are located outside the fixture arms where they are easily accessed to rotate the mandrel assembly.

In a further form at least one of the mandrels comprises a first set of circumferential detents between the inner and outer ends having a first circumferential spacing. In a further form, the second mandrel comprises a second set of circumferential detents between the inner and outer ends having a second circumferential spacing. Each fixture arm associated with a detent-equipped mandrel comprises a detent locking mechanism for selectively and independently engaging the detents on the mandrels. The mandrel assembly can be shifted back and forth in the fixture arms to engage one or the other of the sets of detents in order to adjust the spacing of the detent positions.

A further feature is a tool-supporting bridge extending between the fixture arms above the ring-support location to hold an engraving tool above the ring. In one form the bridge comprises a sliding tool holder for positioning a tool orthogonally above a ring on the mandrel assembly. The tool holder can be locked in position to secure a tool in place relative to the ring.

In a further form the bridge is offset from vertical to provide better physical and visual access to the ring, and to allow the use of a microscope. In a further form the fixture base is generally U-shaped, with the ring-engraving location opening upwardly between the fixture arms, and the tool-supporting bridge is removably connected between the fixture arms.

In a further form the invention is a system comprising the ring fixture base; a removable tool-supporting bridge with a sliding, selectively lockable tool holder; and at least one collet adapted to be secured on the mandrel assembly of the fixture base.

In a further form, the fixture base is vise-compatible, and includes two sets of vise-engaging surfaces, one set flat and one set radiused, to allow different vise-mounting angles. In a further form, an additional set of flat, 45-degree angled vise-engaging surfaces are provided.

These and other features and advantages of the invention will become apparent from the detailed description below, in light of the accompanying drawings.

BRIEF DESCRIPTION OF THE DRAWINGS

FIG. 11 is an exploded assembly view of the ring fixture system.

FIG. 11A is a sectional view of the collet in FIG. 11.

DETAILED DESCRIPTION

Figure 1:
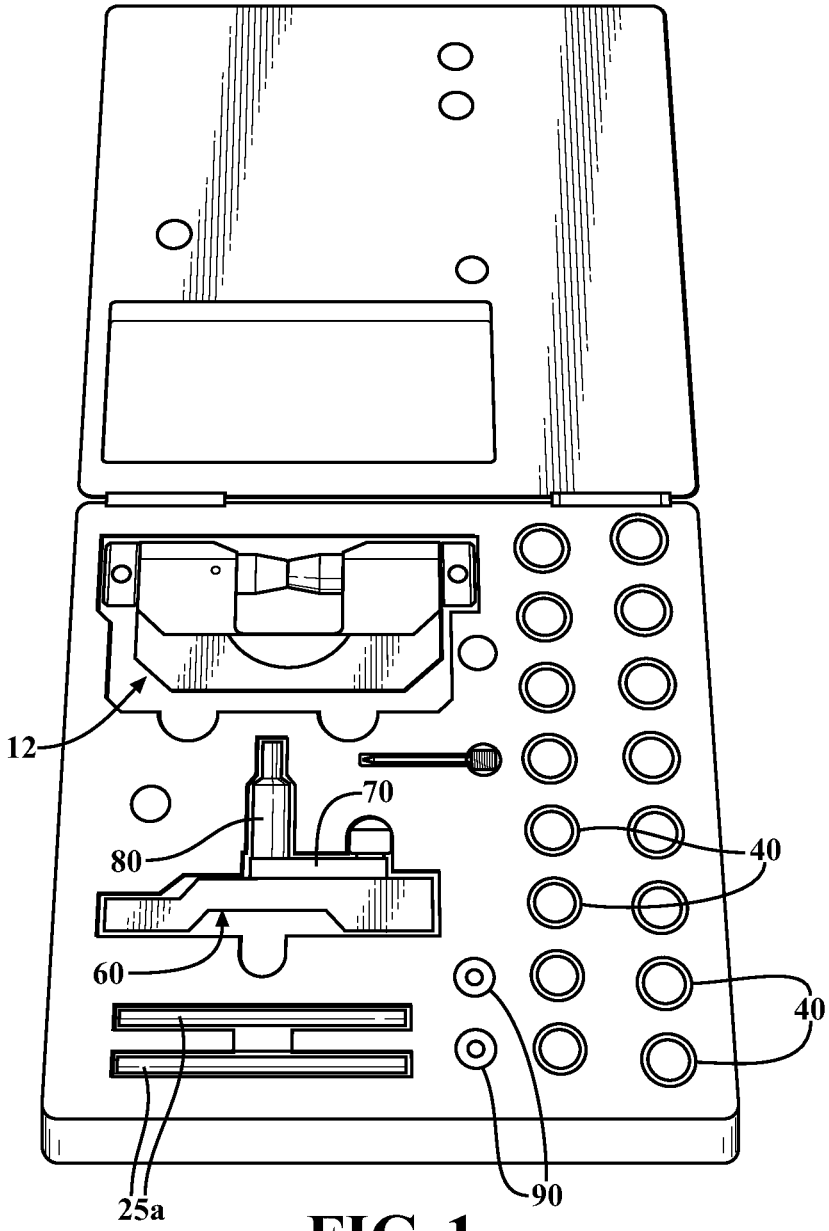
FIG. 1 is a plan view of a ring engraving system including an exemplary and currently preferred fixture base, tool-supporting layout fixture bridge, ring engraving tools, and collets according to the present invention, supplied in kit form.
Figure 2:
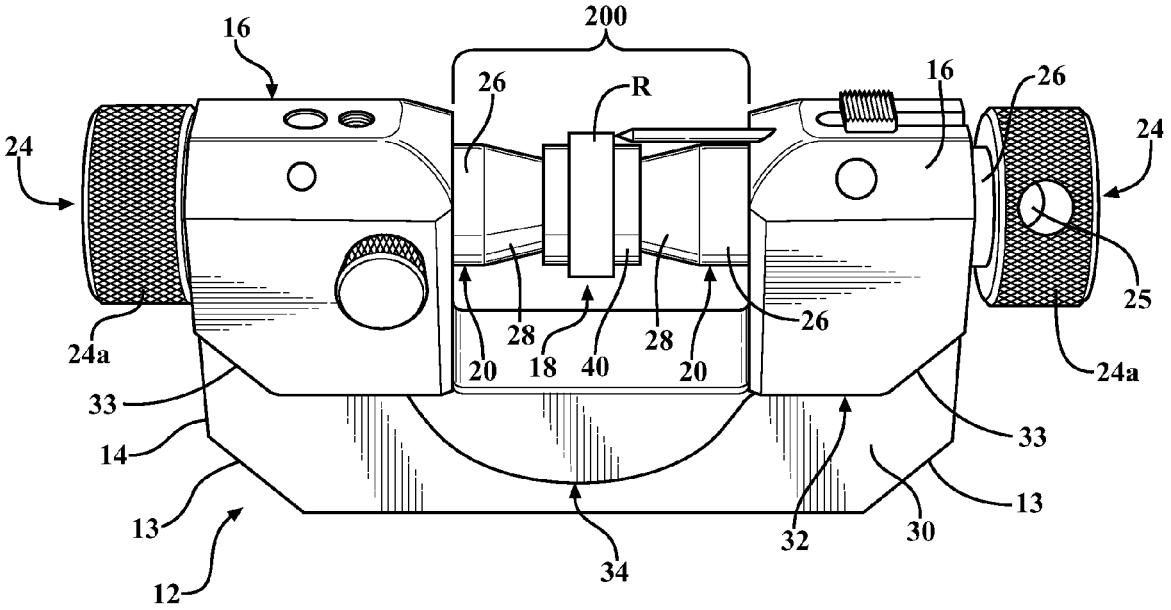
FIG. 2 is a perspective view of the fixture base of FIG. 1.
Figure 3:
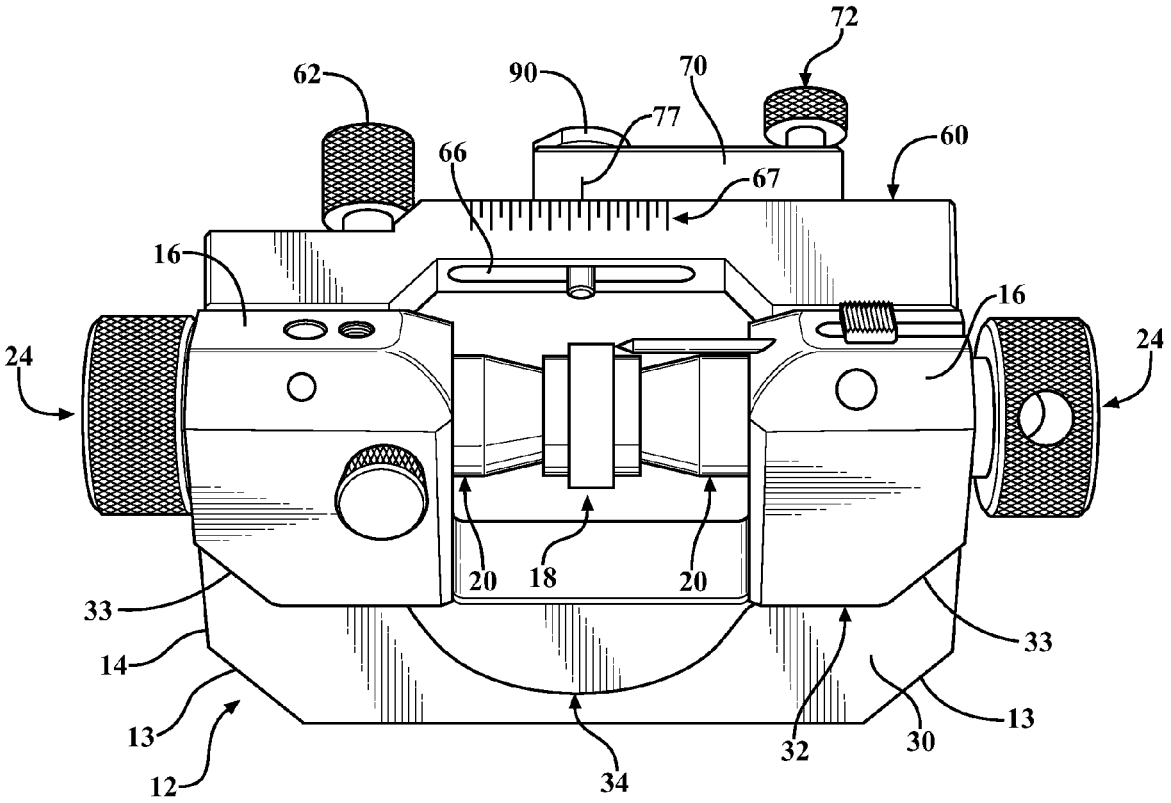
FIG. 3 is similar to FIG. 2, but shows the tool-supporting bridge attached to the fixture base.

Referring first to FIGS. 1 through 3, a ring fixture system is shown in exemplary form, in order to teach how to make and use the claimed invention. In FIG. 1 the ring fixture system is shown disassembled into its main components and accessories and packaged as a boxed kit. The ring fixture system includes a fixture base 12, a removable tool-supporting "bridge" 60 with a sliding tool holder 70, and engraving tools 80 and 90. Sets of aluminum and nylon ring-holding collets 40 are also included in different sizes, adapted to fit on a mandrel assembly formed by connecting the mandrels 20 on the fixture base 12.

FIG. 2 (also see FIG. 11) shows the fixture base 12, useful on its own for many ring engraving tasks. Fixture base 12 includes a generally U-shaped body 14, for example made from machined aircraft aluminum without limitation as to the material used or the manner of forming it. Body 14 includes upwardly extending support arms 16 defining an open ring-engraving location 18 between them. Arms 16 include horizontal bores 16*a* that rotatably support mandrels 20. Mandrels 20 are ideally removably mounted in the fixture arms, but in their operative position in the fixture base their inner ends 22 are located between arms 16, their main shafts 26 are rotatably mounted in the bores 16*a*, and their outer ends 24 are located outside arms 16 where their grip or knob ends 24*a* can be manually rotated to turn the mandrels 20 in arms 16. The inner ends 22 of mandrels 20 are designed to be connected to form a single mandrel assembly 200, for example via illustrated male and female threaded portions 22*a* and 22*b*. Mandrel assembly 200, i.e. mandrels 20 threaded and locked together in the fixture base, can then be turned as a unit in arms 16 using either knob end 24*a*. It will be understood that the term "knob" used to describe the outer ends of the mandrels 20 encompasses many different shapes and structures, as long as the outer ends 24 can be used to manually turn the mandrels.

Mandrel outer ends 24*a* can be provided with bores 25 adapted to receive tightening tools such as rods 25*a* (FIG. 1), allowing the two mandrels 20 to be tightened together with greater force.

It should be understood herein that terms of orientation such as "upwardly" and "horizontal" used in reference to the fixture base 12 and other components of the ring fixture system are dependent on the orientation of the objects being described. It will be assumed, however, that unless otherwise stated the fixture base 12 is being described in an essentially upright orientation, without limiting the actual orientation during use.

Mandrels 20 include tapered ring-supporting (or, more precisely and typically, ring-and-collet supporting) regions 28 adjacent their inner ends. A collet 40 with a ring R mounted thereon is placed over one of the tapered regions 28 on one of the mandrels 20, and then the other mandrel is inserted through the collet and threaded into locking connection with the other mandrel to form mandrel assembly 200. The ring-supporting collet 40 is then frictionally held in place by the tapered surfaces 28 extending through the collet, so that the ring rotates with the mandrel assembly, and so that the ring remains fixed securely in place while being engraved, etc. If a split collet 40 is used, as preferred and illustrated (see FIGS. 11 and 11A), the collet may be expanded in tension by the tapered ends of the mandrels.

Figure 4:
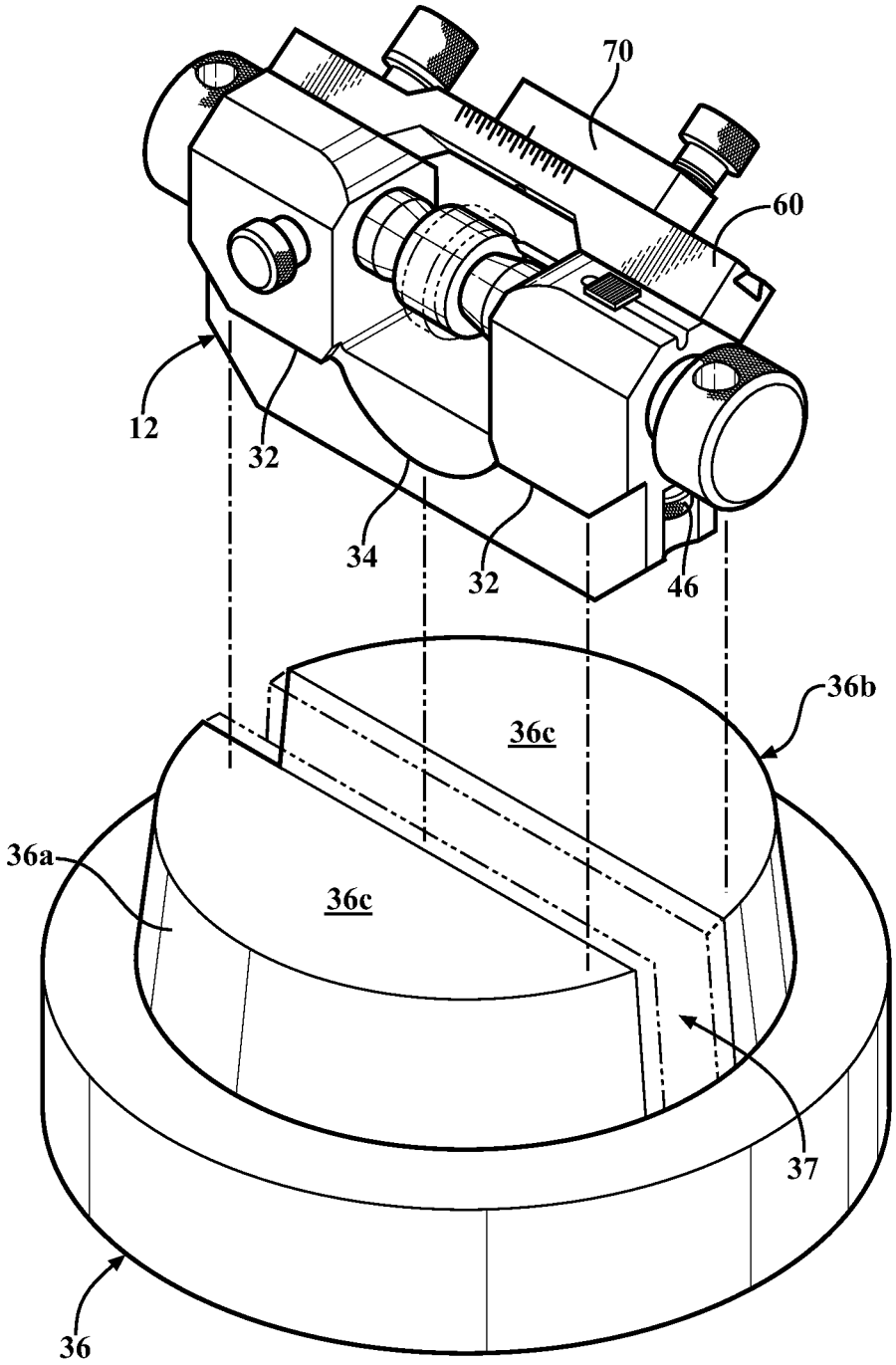
FIG. 4 is an exploded assembly view of the fixture base relative to a jeweler's vise.
Figure 8:
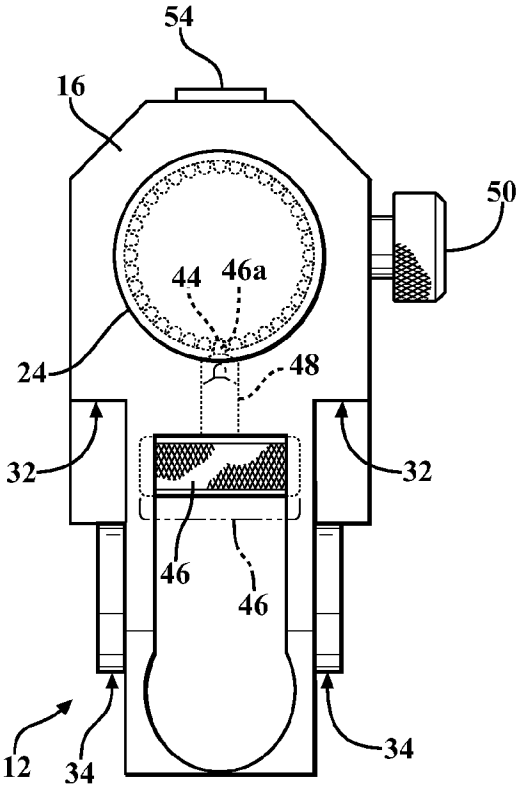
FIG. 8 is an end view of the fixture base, with a detent locking mechanism in one arm of the fixture base engaging a set of detents in solid lines, and loosened to free the detents and the mandrel assembly in phantom lines.
Figure 7:
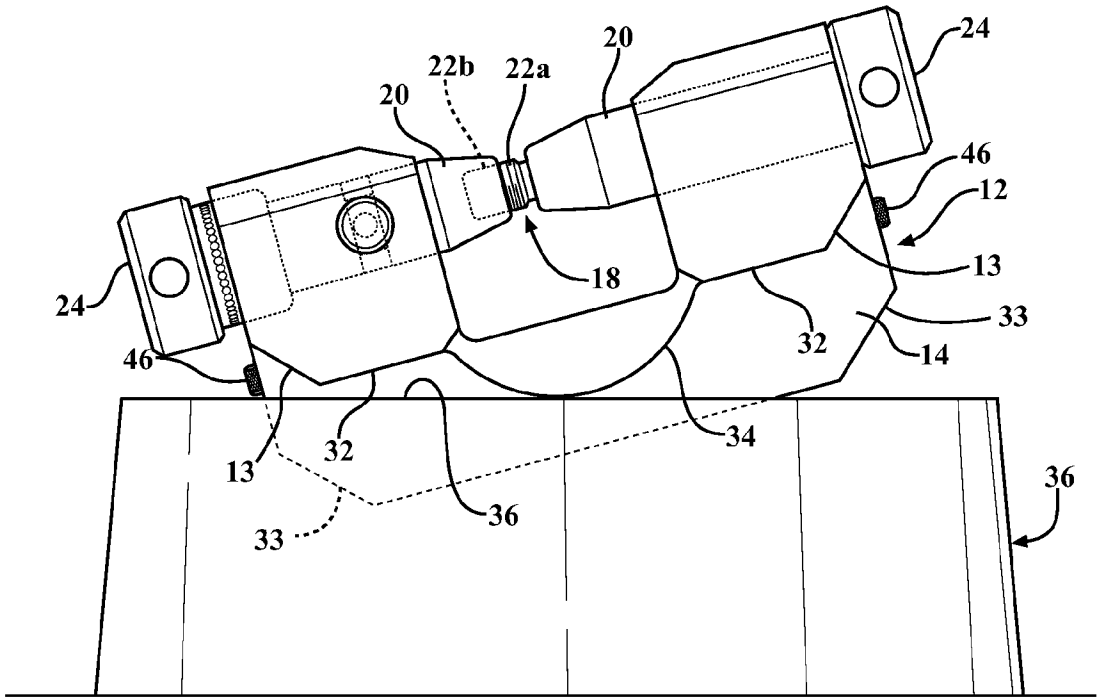
FIG. 7 is a perspective view of the fixture base of FIG. 1 with a radiused shoulder portion resting on the surface of a vise holding the fixture base at an angle relative to the flat surface of the vise.

Fixture base body 14 is shown with sidewalls 30 provided with three vise-mounting options: flat horizontal shoulders or ledges 32 extending a first greater distance out from either sidewall 30, near the upper end of body 14; flats 13 and 33, angled at 45° from horizontal for resting the ends of body 14 or arms 16 on the flat surfaces of a vise or other work surface; and a radiused shoulder or ledge 34 on each sidewall, extending a lesser distance out from the sidewalls below the flat shoulders 32. Referring to FIG. 4, fixture base body 14 can accordingly be placed in the adjustable-width slot 37 between the halves 36*a*, 36*b* of a jewelers' or other vise 36, and secured in place in two ways. A first way is with flat shoulders 32 resting on the upper surface 36*c* of the vise, with vise halves 36*a*, 36*b* farther apart, for a standard horizontal mount. Alternately, the vise spacing is narrowed, and radiused shoulders 34 are placed on the upper surface 36*c* of the vise for a tilted mount. In the illustrated example, the radiused shoulders 34 are semi-circular, allowing the fixture base 12 to be mounted on vise 36 at any angle through an approximately 90-degree arc, as best shown in FIG. 8.

It will be understood that fixture base 12 may be configured to fit different vise or support structures than that shown. For example, a threaded bore may be provided in the lower surface of base 12 for securing the base to a support using a threaded connector. Other mounting options are also possible.

Fixture base 12 may be described as generally U-shaped, meaning that arms 16 are spaced and leave an upwardly facing ring-engraving location 18 open between them.

FIG. 3 shows U-shaped fixture base 12 supplemented with a tool-supporting layout bridge 60. Layout bridge 60 is removably attached to upper ends of the fixture base arms 16 via locating studs 61 and a thumbscrew or other connector 62 engaging pilot holes 16*p* and threaded bores or other mating structure on the fixture arms 16. Layout bridge 60 may be made from machined aluminum, as with other parts of the fixture system without limitation as to material or the manner of forming it. Layout bridge 60 includes a sliding tool holder 70 mounted to slide back and forth along at least a portion of the length of bridge 60, for example with a dovetail 74 sliding in a dovetail groove 64 on the upper side of the bridge (FIG. 11). Tool holder 70 includes a partially-threaded bore 76 for receiving and securing a ring engraving tool, for example one of the illustrated scribe or drill guide tools 80, 90 described in more detail below. Bore 76 aligns with a tool access slot 66 in bridge 60 overlying the ring-engraving location 18, such that a tool in holder 70 can be operated through access slot 66 to engage a ring held on the mandrel assembly.

Tool holder 70 can slide freely back and forth in bridge 60 over the access slot, and can also be locked in place with a set screw 72 (or other releasable locking mechanism) engaging a suitable surface on the bridge, for example a bottom surface of the dovetail groove 64 (toward the right end of bridge 60 in FIG. 11) not aligned with the tool access slot 66. Precise, repeatable positioning of any tool on tool holder 70 relative to the mandrel-mounted ring can be guided, for example, by a visual scale 67 marked on the side of the bridge (corresponding to the access slot), and by a corresponding alignment mark 77 on tool holder 70.

While layout bridge 60 is illustrated as a removable piece that allows the fixture base 12 to be used without the bridge, it will be understood that layout bridge 60 could be integrated permanently with fixture base 12.

Referring to FIG. 11, the parts of fixture base 12 and bridge 60 have been exploded for further explanation. Mandrels 20 include first and second sets of circumferential detents 42 and 44, respectively, in the illustrated example each set of detents marking a different degree of rotational adjustment for the associated mandrel. For example, first detents 42 are spaced at 45-degree intervals around the circumference of the first mandrel, while second detents 44 are spaced at 10-degree intervals around the circumference of the second mandrel. The detents 42, 44 may be formed as grooves or dimples or slots in the surfaces of the mandrels 20, adapted to receive the end of a detent screw or pin 46 mounted in each arm 16 of the fixture base. It will be understood that other forms of detent structure may also be used to provide a detent function similar to that described herein, and that different detent spacings than the illustrated 10° and 45° examples are possible.

Detent pins 46 are threadably and adjustably mounted in vertical bores 48 in each arm 16. Bores 48 open into mandrel bores 16*a*, so that the ends 46*a* of pins 46 can be threadably adjusted via knurled head 46*b* toward and away from the detents 42 or 44 on the mandrel 20 in the associated bore 16*a*. In the illustrated example, the ends 46*a* of the detent pins 46 comprise spring-loaded balls biased away from the pin under tension, such that they snap into place in the detents 42, 44 as the detents are aligned with the pin ends, and yield under tension when the mandrel is rotated. Thread-adjustable detent pins 46 can be adjusted against their respective mandrels to lock the mandrels against rotation; to allow the mandrels to rotate while the pins snap into place against the detents, with varying degrees of force; or to allow the mandrels to rotate freely without engaging the detents.

At least one of the mandrels 20 may be provided with a separate, continuous drag adjustment feature such as drag groove 21, adapted to frictionally receive the tip of a drag screw 50 mounted for adjustment toward and away from mandrel 20, for example mounted in a threaded bore 52 formed through one of the fixture arms 16. Drag groove 21 is wider than the width of drag screw tip 50*a* in the illustrated example, to allow for side-to-side adjustment of the mandrel 20 in arm 16 while the drag screw is engaged with groove 21. Drag screw 50 provides drag control over the mandrel assembly's rotation between detent positions, or when both sets of detents are disengaged from their respective detent pins.

Figure 5:
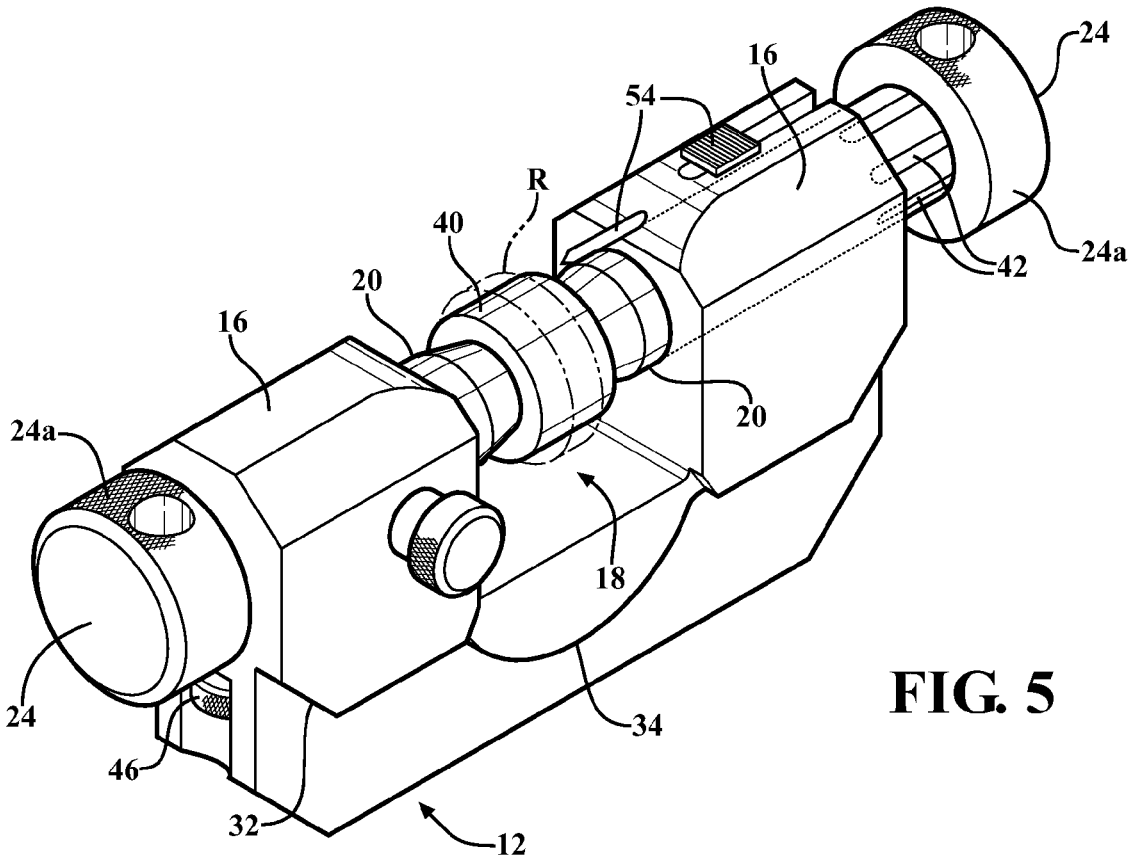
FIG. 5 is a perspective view of the fixture base of FIG. 4 with the mandrels assembled and the mandrel assembly shifted to engage a first set of circumferential detents.

Referring to FIG. 5, mandrels 20 have been inserted through respective arms 16 of the fixture base, with their inner ends 22 connected through a collet-supported ring R at ring-engraving location 18. The resulting mandrel assembly 200 is shown shifted to the right in the fixture base 12 so that detent set 44 is aligned with the respective detent pin 46 in associated arm 16. The length of the mandrel assembly 200 may be such that the other, non-engaged set of detents (here, 42) is visible to the exterior of its associated fixture arm 16, indicating which set of detents is engaged (44) and which is not (42). When mandrel assembly 200 is turned from either end 24 to rotate ring R, the interaction of detent pin 46 with detents 44 provides a positive audible and/or tactile click to indicate that the ring R has been rotated a precise 10°.

Figure 6:
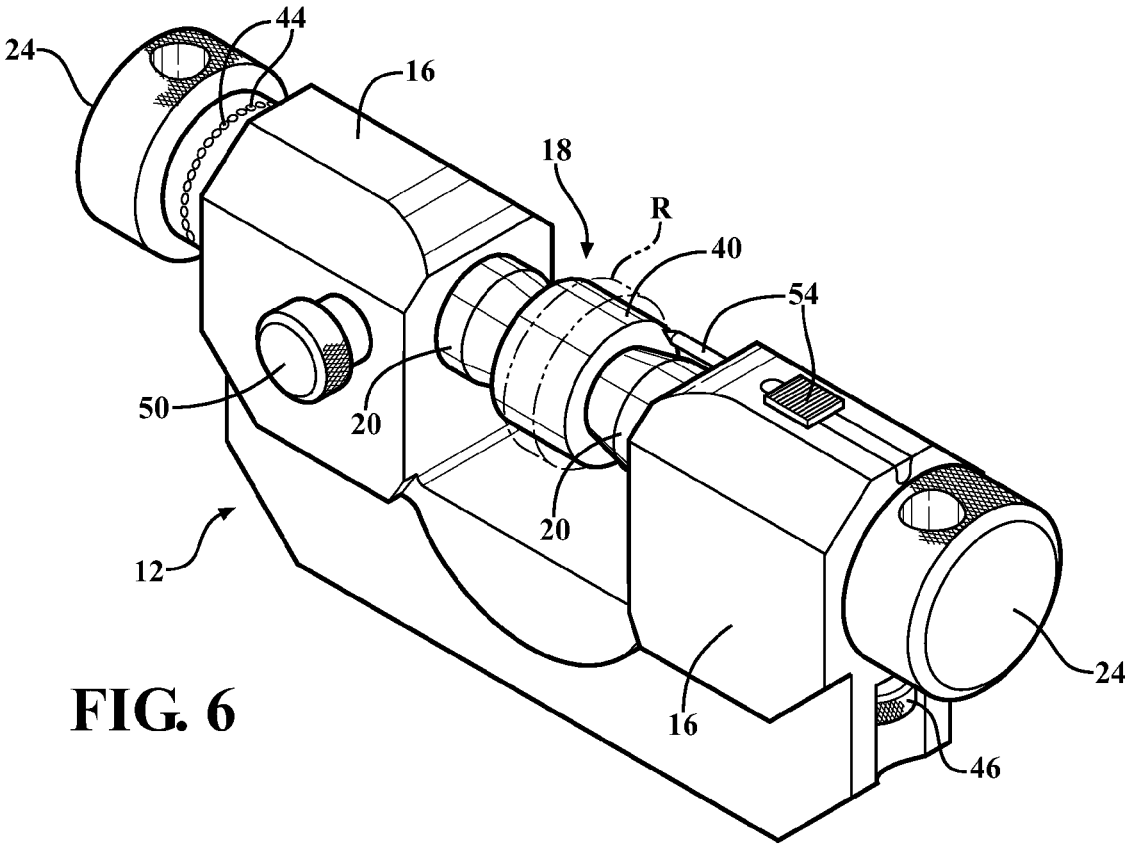
FIG. 6 is similar to FIG. 5, but shows the mandrel assembly shifted in the opposite direction to engage a second set of circumferential detents.

Referring to FIG. 6, mandrel assembly 200 has been shifted in the opposite direction to engage the second set of detents 42 with the detent pin 46 in the opposite fixture arm 16. Now the first set of detents 44 is visible (and disengaged) on the opposite exterior side of the fixture base, and rotation of ring R on mandrel assembly 200 can be controlled in precise 45° increments.

Referring to FIGS. 5, 6, and 8, detent screws 46 can be individually tightened and loosened relative to their respective mandrels 20.

Each time the ring R is rotated to a new engraving position, a sliding pointer 54 located on one or both of the fixture arms 16 can be moved toward ring R to assist the jeweler with marking that position on the face or side of the ring. In this way the ring can be quickly "divided" with a small handheld scribe or other tool to do a "layout". Other ring engraving operations may also be performed with the assistance of the pointer.

Ring R can be positioned in-between any of the detent positions by locking the first mandrel 20 with drag screw 50, loosening the other mandrel 20 by unscrewing it partway from the first mandrel 20 until ring R on collet 40 can be rotated to a position between two adjacent detent positions, and then by retightening the mandrels 20 to hold the ring R in place. For example, if ring R has been marked with a scribe at two adjacent 10-degree detent positions, a jeweler can engage drag screw 50 with one mandrel, loosen the other mandrel, rotate the ring/collet assembly to a position between those already marked, and then retighten the mandrels to lock ring R in position before making a mark between the previously-marked detent positions.

Figure 9:
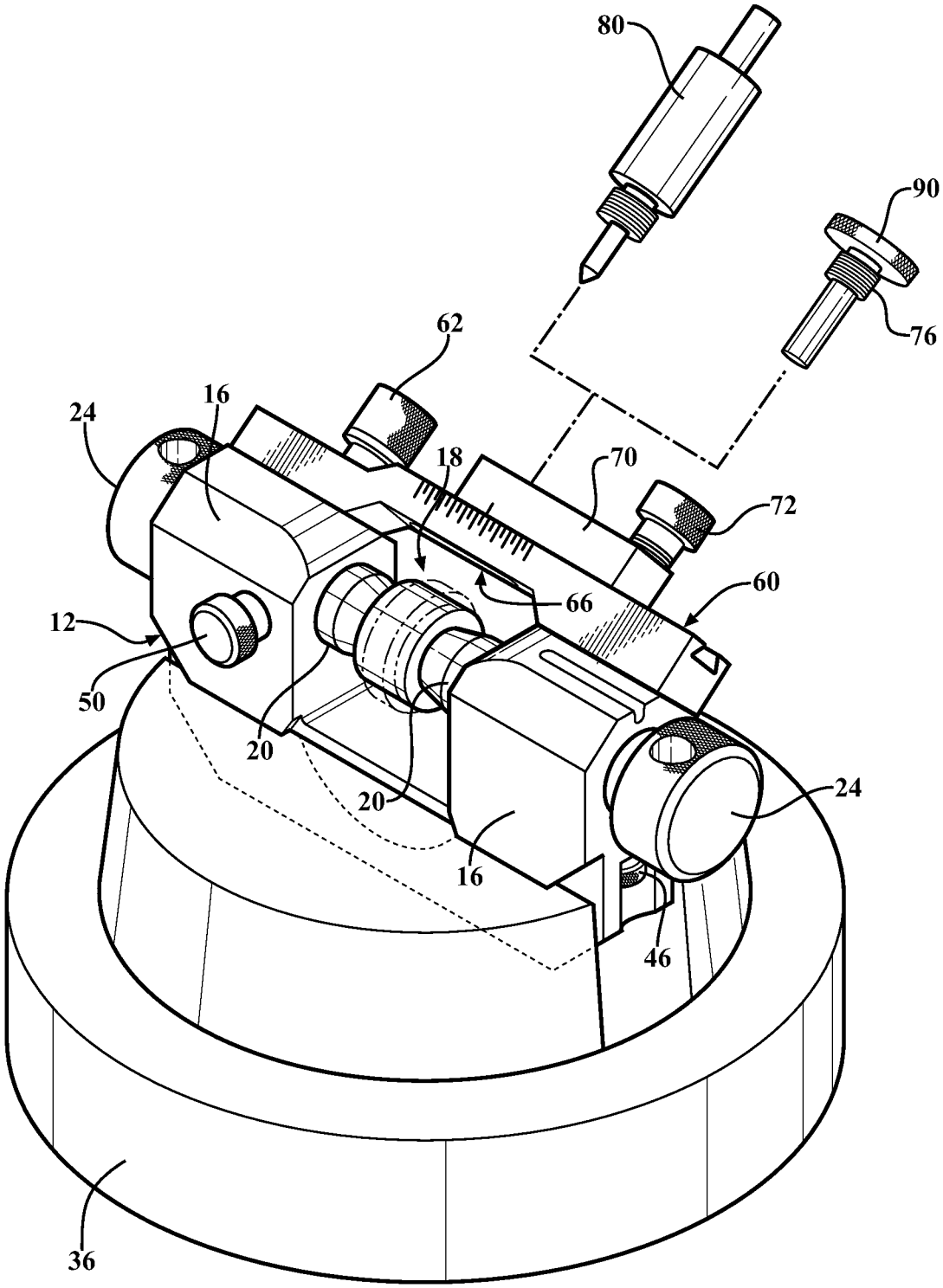
FIG. 9 is a perspective view of the tool-supporting bridge assembled to the fixture base, and with a sliding tool holder shown in different positions in phantom and solid lines.
Figure 9A:
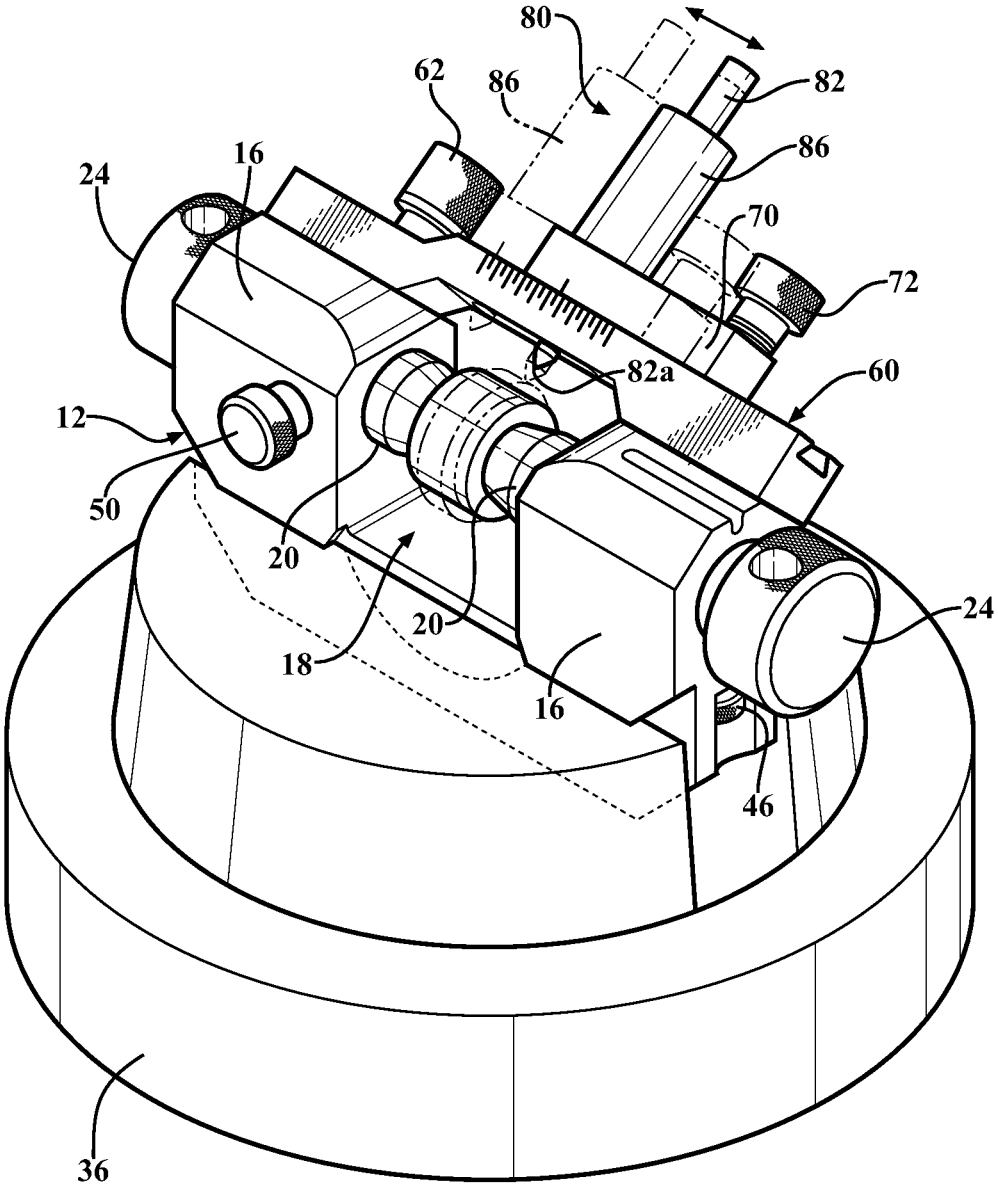
FIG. 9A shows a spring-loaded scribing tool from FIG. 1 secured in the tool holder.
Figure 9B:
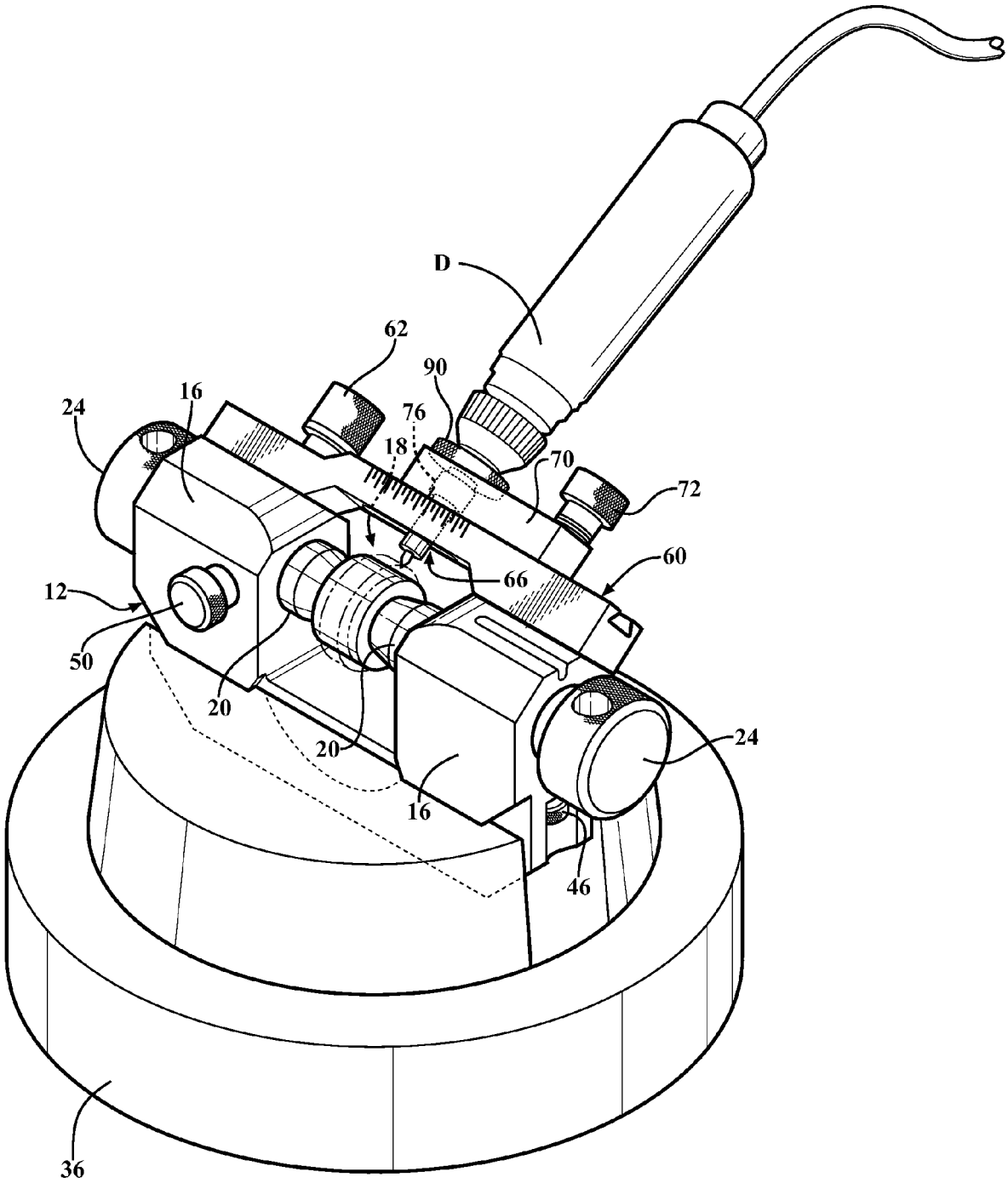
FIG. 9B shows a drilling guide from FIG. 1 secured in the tool holder.
Figure 10:
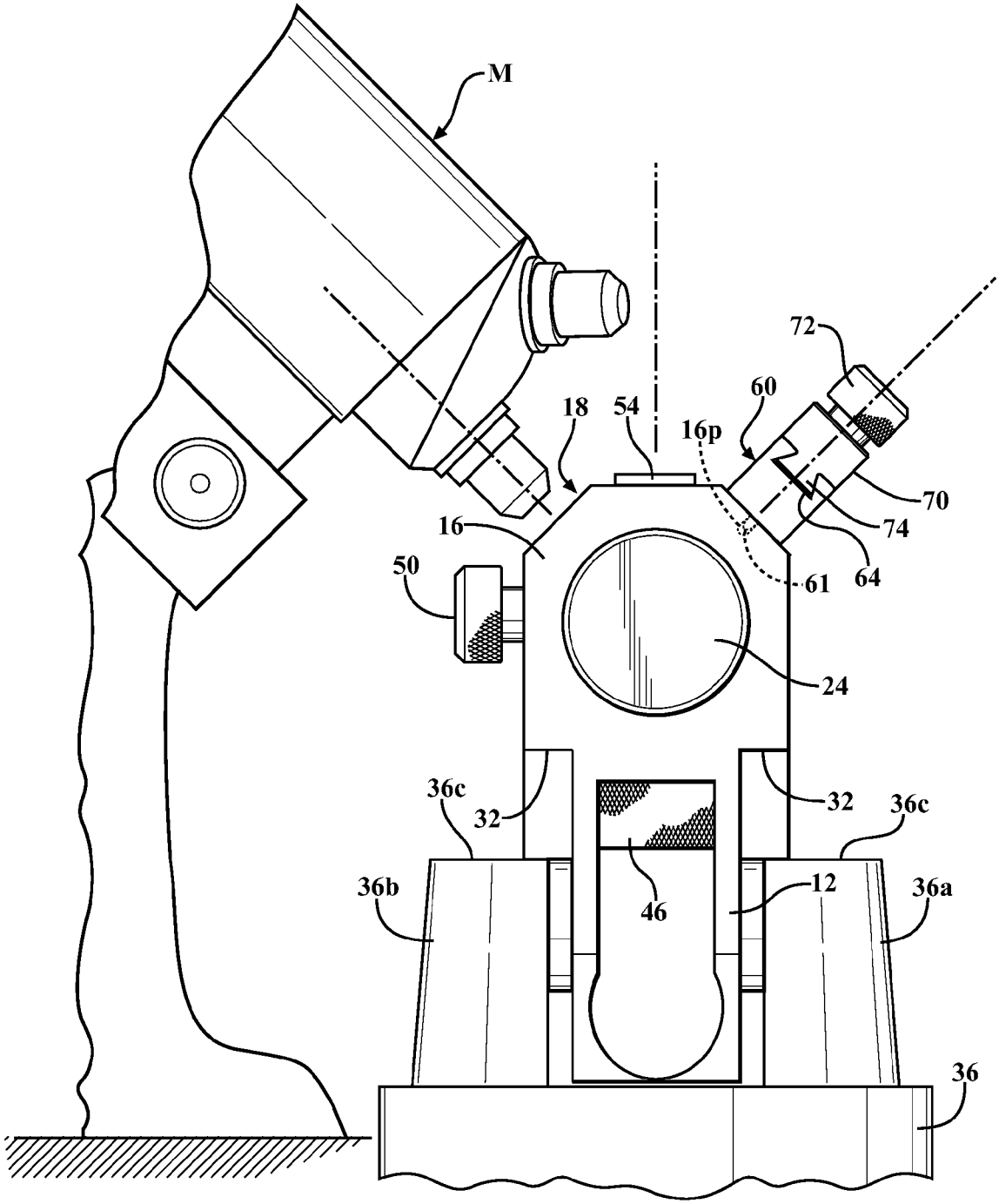
FIG. 10 shows an end view of the fixture base and assembled tool-supporting bridge of FIG. 9 to illustrate a radial offset of the bridge relative to the top of the base.

FIG. 9 shows layout bridge 60 mounted on fixture base 12, by inserting two alignment pins 61 into mating holes 16*p* formed on the upper ends of fixture arms 16, and by engaging the set screw 62 on the bridge with a mating threaded bore 16*b* on one of the fixture arms. Layout bridge 60 is angled from vertical, for example at a preferred 45° from vertical as best shown in the side views of FIGS. 8 and 10, allowing unobstructed visual and physical access to the ring-engraving location 18 between the fixture arms. This offset bridge angle reduces the need to tilt the fixture base 12 (or the vise) for access to the mandrel-mounted ring, and allows the unobstructed use of a microscope M to view work on the ring, if desired.

Tool holder 70 securely holds a tool such as scribe 80 or drilling guide 90 over the mandrel-mounted ring, such that the operative portion of the tool is orthogonal to the ring axis (and thus essentially perpendicular to the face of the ring) and can be inserted or extended through the access slot 66 to engage the ring. In the illustrated embodiment, scribe assembly 80 includes a hard-tipped plunger 82 spring-mounted in a bore 84 in scribe body 86 with an upward bias, i.e., with tip 82*a* normally retracted toward body 86 but still visible. When scribe 80 is screwed into tool holder 70, the tip 82*a* of plunger 82 is visible above the ring R to help align it with a desired spot on the face of the ring. Once aligned, plunger 82 is pressed down with a finger or tool to make a mark on the face of the ring. Plunger 82 can be used to mark the ring with a point-mark at any location on the face of the ring; or it can be held down while the tool holder 70 is moved back and forth across the face of the ring to scribe axial lines across the face of the ring; or it can be held in contact with the face of the ring as the ring is rotated with the mandrel assembly to scribe circumferential lines around the face of the ring. For any or all of these operations, scribe 80 can be locked in place by securing tool holder 70 to the bridge 60 with set screw 72, or scribe 80 can be moved back and forth by leaving tool holder 70 unsecured.

Drilling guide 90 can be secured in tool holder 70 in place of scribe 80, and serves as a guide for a jeweler's drill or similar tool such as D. A drill is useful for drilling holes in the ring, or for cutting channels by drilling to a limited depth in the face of the ring and turning the ring via the mandrel assembly at the same time. Drilling guide 90 is preferably made from a hardened steel to resist wear from the drill bit.

While scribing tool 80 and drilling guide tool 90 are the illustrated tool options, and are believed to be inventive in their own right, it will be understood that other tools useful for engraving, layouts, cutting, milling, drilling, and other work on the surface of a ring could be mounted on tool holder 70 in bridge 60. The ability to securely hold and position a tool above the ring R with a bridge 60 that is effectively integrated into the ring-holding fixture base 12, and to engage the tool against or across the ring face without vibration or unwanted movement, saves the jeweler significant time, and greatly increases the precision of any engraving work.

The illustrated ring fixture system also includes a ring-supporting collet 40. In the illustrated embodiment a set of differently-sized collets 40 is provided for supporting differently-sized rings, the collets made from material such as aluminum or nylon. Illustrated metal collets 40 are inventive split collets, with a radial split 40*a* on one side and with a radial relief area 40*b* on an inner face 40*c* opposite the split. Relief area 40*b*, which reduces the wall thickness of the collet, allows a metal collet to flex without fatigue, prolonging its useful life. Illustrated collets 40 have tapered inner surfaces 40*c* matching the tapered angle of collet-engaging regions 28 on mandrels 20, and the relief area is an approximately semi-circular groove, being wider in the middle where the tapered surfaces 40*c* meet and where the wall thickness is the greatest.

In the preceding description, various aspects and examples and configurations of making and using the invention as defined by the claimed subject matter (the "invention") have been described for purposes of explanation, to provide a thorough understanding of the invention, and to enable those skilled in the art to make and use the invention. However, these are merely example illustrations and descriptions of inventive concepts, and the scope of the invention is not limited in these respects. It should be apparent to one skilled in the art having the benefit of this disclosure that the invention may be practiced without being limited to the specific details of the disclosure. In other instances, well-known features were omitted and/or simplified so as not to obscure the invention. While certain features have been illustrated and/or described herein, many modifications, substitutions, changes and/or equivalents will now occur to those skilled in the art. It is, therefore, to be understood that the appended claims are intended to cover all such modifications and/or changes as fall within the true spirit of invention as reflected by the preceding disclosure. It should further be understood that to the extent the term "invention" is used herein, it is not to be construed as a limiting term as to number or type of claimed or disclosed inventions, or the scope of any such invention, and does not exclude discoveries or designs; rather, it is a term which has long been conveniently and widely used to describe new and useful improvements in science and the useful arts.

What is claimed is:

1. A ring fixture apparatus, comprising:

first and second mandrels comprising outer ends and connectable inner ends, the mandrels rotatably and slidably mounted in respective spaced, fixed position fixture arms of a fixture base in opposing fashion, such that their inner ends are located between the fixture arms and are coaxially aligned, the inner ends configured to be separably connected to one another in a ring-supporting configuration at a ring-engraving location defined between the fixture arms to form an integrated rotating mandrel assembly defining a rotating ring support location at the connection of the inner ends between the fixture arms, and such that their outer ends are located exteriorly of the fixture arms outside the ring-engraving location and are accessible and manually rotatable from outside the ring-engraving location.

2. The ring fixture of claim 1, wherein the first mandrel comprises a first set of circumferential detents between the inner and outer ends having a first circumferential spacing, and a first fixture arm associated with the first mandrel comprises a detent locking mechanism for selectively engaging one of the first set of circumferential detents on the first mandrel, and wherein the second mandrel comprises a second set of circumferential detents between the inner and outer ends having a second circumferential spacing, and each fixture arm comprises a detent locking mechanism for selectively and independently engaging one of the first and second sets of circumferential detents on the first and second mandrels.

3. The ring fixture of claim 1, further comprising a tool-supporting bridge non-movably attached to and connected between upper ends of the fixture arms above the ring-support location.

4. The ring fixture of claim 3, wherein the fixture base is generally U-shaped, and wherein the ring-engraving location opens upwardly between the fixture arms, and wherein the tool-supporting bridge is removable attached to and connected between the fixture arms.

5. The ring fixture of claim 3, wherein the fixture arms are aligned to define a first plane, and wherein the tool-supporting bridge connected between the fixtures arms in a second plane at a rotational offset to the first plane of fixture arms.

6. The ring fixture of claim 3, wherein the tool-supporting bridge comprises a sliding tool support for adjustable positioning a ring-engraving tool over a ring in the ring-support location.

7. The ring fixture of claim 6, wherein the sliding tool support is selectively lockable in different positions on the tool-supporting bridge.

8. The ring fixture of claim 6, further comprising a scribing tool adapted to be held in the sliding tool support orthogonally to the axis of the mandrel assembly, the scribing tool comprising a hard-tipped plunger normally biased by a spring member away from the ring-support location.

9. The ring fixture of claim 6, further comprising a drilling guide adapted to be held in the sliding tool support orthogonally to the axis of the mandrel assembly.

10. The ring fixture of claim 6, wherein the tool-supporting bridge comprises a tool access opening for a tool mounted on the sliding tool support to extend through the tool-supporting bridge to engage a ring in the ring-support location.

11. The ring fixture of claim 10, wherein the tool access opening defines a tool axis essentially orthogonal to the axis of the mandrel assembly.

12. The ring fixture of claim 1, further comprising a ring-supporting collet removably mounted on the ring support location on the mandrel assembly when the inner ends of the mandrels are connected in the ring-supporting configuration.

13. The ring fixture of claim 12, wherein the collet comprises an annular sidewall with a split, and a relieved area of reduced wall thickness on an inner side of the sidewall opposite the split.

14. A ring fixture apparatus, comprising:

first and second mandrels comprising outer ends and connectable inner ends, the mandrels rotatably and slidably mounted in respective spaced, fixed position fixture arms of a fixture base in opposing fashion, such that their inner ends are located between the fixture arms and are coaxially aligned, the inner ends configured to be separably connected to one another in a ring-supporting configuration at a ring-engraving location defined between the fixture arms to form an integrated rotating mandrel assembly defining a rotating ring support location at the connection of the inner ends between the fixture arms, and such that their outer ends are located exteriorly of the fixture arms outside the ring-engraving location and are accessible and manually rotatable from outside the ring-engraving location;

wherein the first mandrel comprises a first set of circumferential detents between the inner and outer ends having a first circumferential spacing, and a first fixture arm associated with the first mandrel comprises a detent locking mechanism for selectively engaging the first set of circumferential detents on the first mandrel;

wherein the second mandrel comprises a second set of circumferential detents between the inner and outer ends having a second circumferential spacing and each fixture arm comprises a detent locking mechanism for selectively and independently engaging the first and second sets of circumferential detents on the first and second mandrels; and, wherein the mandrel assembly has an assembled length greater than a spacing of exterior sides of the spaced arms, such that the mandrel assembly is slidable a limited distance back and forth in the fixture arms between the outer ends to selectively engage one of the first and second sets of circumferential detents with its respective detent locking mechanism in its respective fixture arm, and such that only one of the first and second sets of circumferential detents is engageable with its respective detent locking mechanism in its respective fixture arm at a time.

15. The ring fixture apparatus of claim 14, wherein one of the first and second sets of circumferential detents is visible outside its respective fixture arm when the other of the first and second sets of circumferential detents is aligned for engagement with its respective detent locking mechanism in the other fixture arm.

16. A ring fixture apparatus, comprising:

first and second mandrels comprising outer ends and connectable inner ends, the mandrels rotatably and slidably mounted in respective spaced, fixed position fixture arms of a fixture base in opposing fashion, such that their inner ends are located between the fixture arms and are coaxially aligned, the inner ends configured to be separably connected to one another in a ring-supporting configuration at a ring-engraving location defined between the fixture arms to form an integrated rotating mandrel assembly defining a rotating ring support location at the connection of the inner ends between the fixture arms, and such that their outer ends are located exteriorly of the fixture arms outside the ring-engraving location and are accessible and manually rotatable from outside the ring-engraving location;

wherein the fixture base comprises a sidewall with a first flat vise-engaging shoulder projecting a first distance from the sidewall, and a second radiused vise-engaging shoulder projecting a second lesser distance from the sidewall below the first shoulder.

* * * * *